United States Patent [19]

Horeschi et al.

[11] Patent Number: 4,552,474

[45] Date of Patent: Nov. 12, 1985

[54] BACKSPACE DEVICE IN TYPEWRITER

[75] Inventors: Giancarlo Horeschi; Gian P. Barozzi, both of Tokyo, Japan

[73] Assignee: Tokyo Juki Industrial Co., Ltd., Tokyo, Japan

[21] Appl. No.: 550,291

[22] Filed: Nov. 9, 1983

Related U.S. Application Data

[63] Continuation-in-part of Ser. No. 287,692, Jul. 28, 1981, abandoned.

[30] Foreign Application Priority Data

Aug. 11, 1980 [JP] Japan ..... 55-110952

[51] Int. Cl.[4] ..... B41J 19/62

[52] U.S. Cl. ..... 400/310; 400/307.2; 400/312; 400/478; 400/665

[58] Field of Search ..... 400/161.1, 166, 307.2, 400/308, 309, 310, 311, 312, 478, 665

[56] References Cited

U.S. PATENT DOCUMENTS

| | | | |
|---|---|---|---|
| 2,879,876 | 3/1959 | Palmer et al. | 400/161.1 |
| 3,366,215 | 1/1968 | Hosey et al. | 400/310 |
| 3,618,736 | 11/1971 | Abell, Jr. et al. | 400/166 |

OTHER PUBLICATIONS

IBM Technical Disclosure Bulletin, "Self-Phasing Backspace Mechanism", Schaefer, vol. 12 No. 12, May 1970, p. 2192.

IBM Selectric Typewriter Service Manual, dated May, 1975, pp. 80, 101, 105, 113, 117.

*Primary Examiner*—Ernest T. Wright, Jr.
*Attorney, Agent, or Firm*—Koda and Androlia

[57] ABSTRACT

A backspace device in a typewriter comprising: an interposer operable by the operation of a key lever; a cycle bail operable by the interposer; a cycle clutch for intermittently transmitting a driving force from a driving source to a main shaft so that the main shaft can be rotated by a predetermined number of times in association with the cycle bail; an actuating bail for performing a cycle of a motion along a moving path of a predetermined mode by a full turn of the main shaft, while rendering to the interposer a motion in a direction of the interposer leaving the cycle bail during the motion; a backspace link for moving in association with the interposer during the leaving motion of the interposer; a backspace rack extending laterally of the typewriter, supported rotatably about an axis laterally disposed and turned to a working position by the backspace link; and a backspace pawl fastened onto a carriage so that it can be reciprocated a predetermined distance in the lateral direction by a cam rotatable integrally with the main shaft and having a toothed portion to be meshed with the backspace rack rotated to the working position; wherein the carriage is retracted by a predetermined value of pitch along the main shaft by a reaction force generated at a portion of the engagement of the backspace pawl with the backspace rack by a motion of the backspace pawl.

3 Claims, 14 Drawing Figures

BACKSPACE DEVICE IN TYPEWRITER

This is a continuation-in-part of application Ser. No. 287,692, filed July 28, 1981, now abandoned.

BACKGROUND OF THE INVENTION

This invention relates to a backspace device in a typewriter, i.e. a device for causing a carriage with a printing mechanism to perform a retracting motion by a predetermined pitch.

The conventional backspace device has been of such an arrangement that a wire for drawing a carriage is moved by a cam fixed on a main shaft, a drum provided on a shaft of a wire drum is rotated and the carriage is retracted by a distance commensurate to the value of rotation of the drum. With this conventional arrangement, since a high tensile force acts on the wire, it has been necessary to enlarge the sizes of parts in view of the mechanical strength, and such disadvantages have been presented that the operation is not smooth and the durability is unsatisfactory.

Since the rotation of the wire drum is effected by the main shaft through a link mechanism, there has been presented a disadvantage that a large space was required to house this link mechanism.

SUMMARY OF THE INVENTION

The present invention has been developed to obviate the abovedescribed disadvantages of the prior art and has as its object the provision of a backspace device in a typewriter, rendered compact in size and smooth in operation.

According to the present invention, a backspace device in a typewriter comprises: an interposer operable by the operation of a key lever; a cycle bail operable by the interposer; a cycle clutch for intermittently transmitting a driving force from a driving source to a main shaft so that the main shaft can be rotated by a predetermined number of times; an actuating bail for performing one cycle of a motion along a moving path of a predetermined mode per rotation of the main shaft during which it renders to the interposer a motion in a direction of leaving the cycle bail; a backspace link operationally associated with the interposer during the motion of the interposer in the direction of leaving the cycle bail; a backspace rack extending laterally of the typewriter, supported rotatably about an axis laterally extending and rotatable to a working position by the backspace link; and a backspace pawl mounted on the carriage to laterally reciprocate a predetermined distance by a cam rotatable with the main shaft and having a toothed portion engageable with the backspace rack which has been rotated to the aforesaid working position; whereby the carriage is retracted by a predetermined pitch along the main shaft by a reaction force generated at a portion meshingly engaged with the backspace rack due to the motion of the backspace pawl.

BRIEF DESCRIPTION OF THE ATTACHED DRAWING

FIG. 1 is a right side view showing the arrangement of the backspace keylever, interposer, backspace link and the like;

DESCRIPTION OF THE PREFERRED EMBODIMENT

Figure 1:
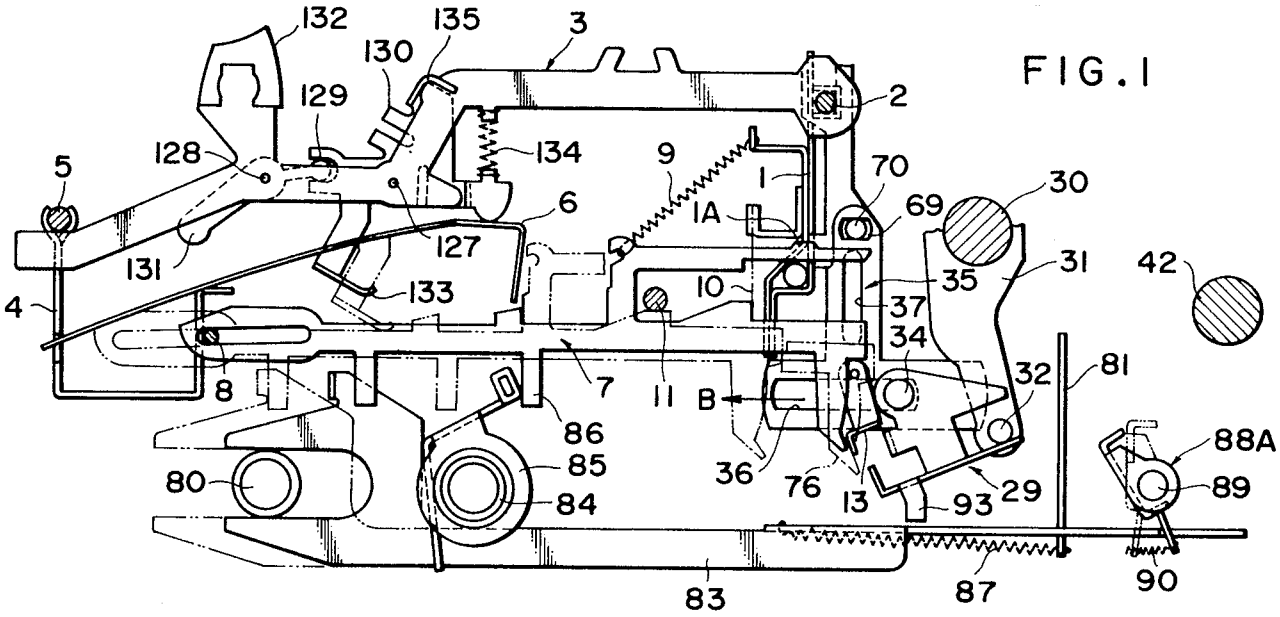

Description will hereunder be given of an embodiment of the present invention with reference to the drawing.

Referring to FIG. 1, a backspace key lever 3 is rotatably supported at a position close to the right end of a shaft 2 provided along a laterally elongate rear guide 1 solidly secured to a frame 1B of a typewriter. This backspace key lever 3, at its forward portion, is controlled in its upward movement by a stop bar 5 secured to a laterally elongate front guide 4, and urged up through repeat lever 130 and spring 134 by a lever spring 6 disposed thereunder.

Figure 3:
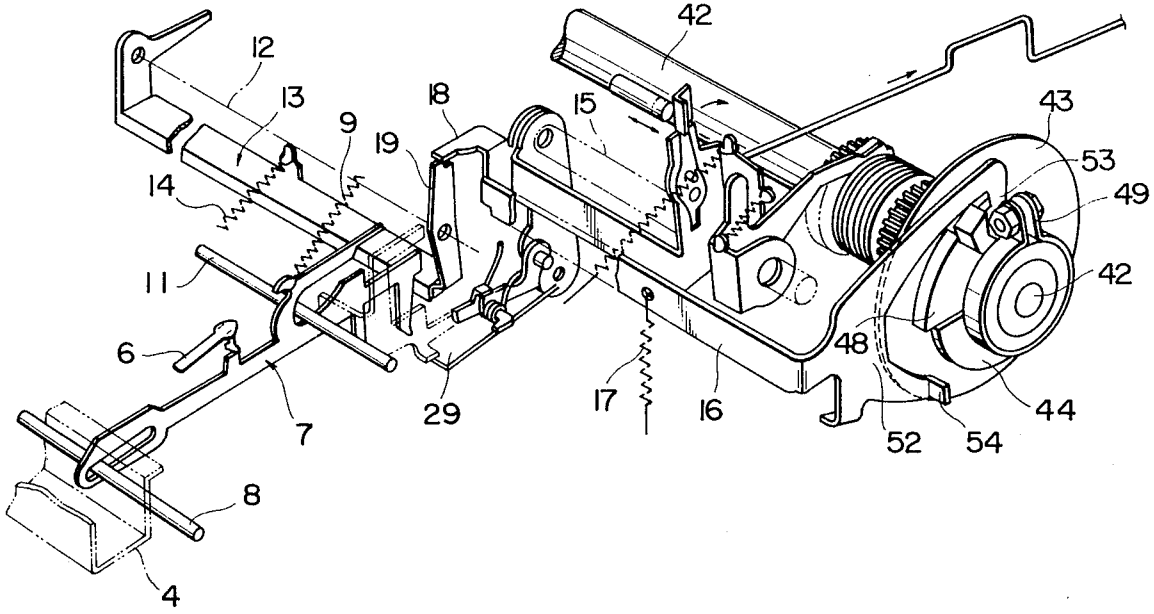
FIG. 3 is a perspective view showing the working mechanism of the cycle clutch.

In FIGS. 1 and 3, an interposer 7 is disposed under the lever spring 6. The interposer 7, being guided by a rod 8 solidly secured to the front guide 4 and a downwardly opened cutout 1A formed in the rear guide 1, is mounted at a position corresponding to the aforesaid backspace key lever 3, urged upwardly and rearwardly by a spring 9, and engaged with a stop spring 10 secured to the rear guide 1. Additionally, designated at 11 is a down stop shaft for restricting the downward movement of the interposer 7.

In FIG. 3, a cycle bail 13 rocking about an axis 12 is disposed behind the interposer 7. This cycle bail 13 is urged by a spring 14 in a direction in which the upper end of the cycle bail 13 is directed to the rear, i.e. in the clockwise direction as viewed from the right side surface of the typewriter (rightwardly rotating direction).

Figure 12:
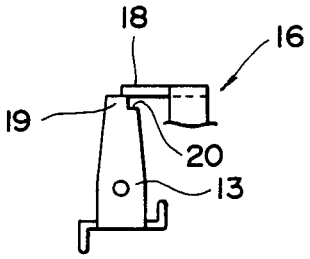
FIG. 12 is a right side view showing the engagement of the cycle bail and the clutch bell crank in the waiting stage.

A clutch bell crank 16 rocking about a shaft 15 is provided at the right side portion of the typewriter behind the cycle bail 13. This clutch bell crank 16 is urged by a spring 17 in the counterclockwise direction, and, as shown in FIG. 12, the forward end portion 18 at one side thereof is normally maintained in a waiting state in which the forward end portion 18 extends over a stepped portion 20 formed on the forward end portion 19 at one side of the aforesaid cycle bail 13 and engages the top surface of the forward end portion 19.

The aforesaid cycle bail 13 is a laterally elongate member and supported at opposite sides thereof. A likewise laterally elongate actuating bail 29 is disposed under the cycle bail 13 (Refer to FIGS. 1 and 3).

Figure 8:
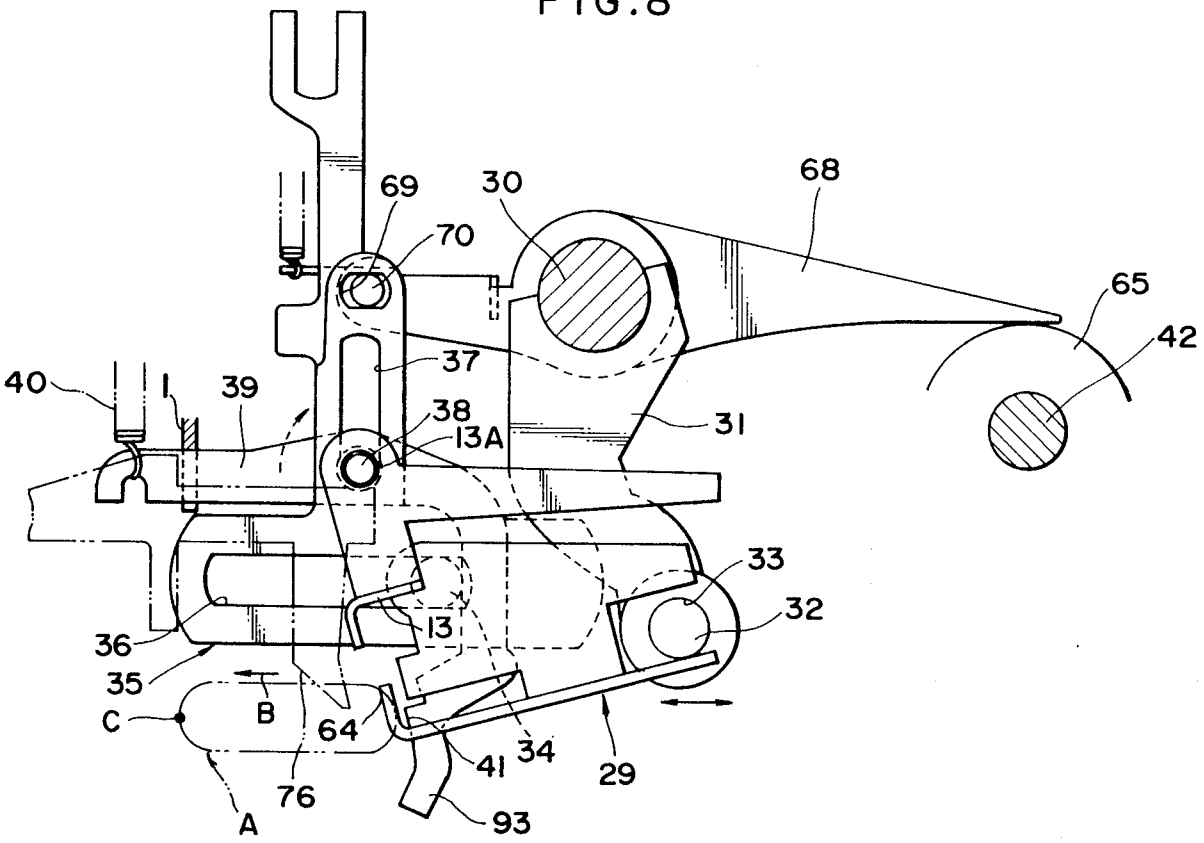
FIG. 8 is a right side view showing moving path generating mechanism for the motion of the actuating bail.

In FIG. 8, this actuating bail 29 is supported at the rear end thereof by two arms 31 solidly secured to laterally opposite sides of a shaft 30 rotatably supported at the left side concentrically therewith. More specifically, an elongate rod 32 is solidly secured to the rear end portion of the actuating bail 29, and the opposite ends of this rod 32 are loosely coupled into holes 33 formed at the forward ends of the aforesaid two arms 31 to support the rod 32. Furthermore, a pin 34 studded on the left side surface of the actuating bail 29 is loosely coupled into a lateral slot 36 of the bail guide 35 so as to support the forward portion of the actuating bail 29.

The aforesaid bail guide 35 is disposed at the left side of the typewriter, and a longitudinal slot 37 formed on the bail guide 35 is loosely coupled onto a stud 38 studded on the left side frame 1C so as to support the bail guide 35. This stud 38 additionally functions as a left side fulcrum for the rocking center pivot 13A of the aforesaid cycle bail 13.

Further, a latch member 39 is rotatingly supported by the aforesaid stud 38. The latch member 39 is mounted on the stud 38 in such a manner that it is urged by a spring 40 in the clockwise direction (as viewed from the right side), its rotation being prevented by the rear guide 1. The latch member 39 is provided at the lower end thereof with an abutting portion 41 for abutting against the actuating bail 29 when the actuating bail 29 moves excessively rearwardly. This makes it possible that the actuating bail 29 reliably contacts the interposer 7 during operation. Since the bail guide 35 is loosely coupled with the stud 70, without the latch member 39, the bail guide 35 would move horizontally by a space between the stud 70 and the hole 69. As a result, the actuating bail 29 would move excessively rearwardly and could not contact the interposer 7.

Figure 13:
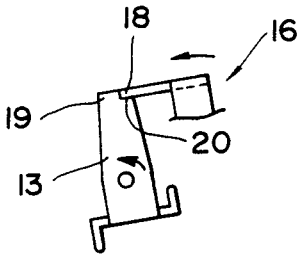
FIG. 13 is a right side view showing the operating state, corresponding to FIG. 12.

FIGS. 12 and 13 show the engagement of the cycle bail 13 with the clutch bell crank 16. As shown in FIG. 12, in the waiting state, the forward end portion 18 of the clutch bell crank 16 extends over the stepped portion 20 of the forward end portion 19 of the cycle bail 13 and engages the top surface of the forward end portion 19 of the cycle bail 13. During operation, when the interposer 7 is depressed by the key lever 3, and the interposer 7 moves rearwardly to press down the lower portion of the cycle bail 13, the cycle bail 13 turns in the counterclockwise direction and the clutch bell crank 16 rotates in the counterclockwise direction, whereby the forward end portion 18 thereof engages the stepped portion 20, so that the state shown in FIG. 13 is brought about. FIG. 13 is the state of clutch-on which will be described hereinafter.

In FIG. 3, a laterally elongate main shaft 42 is rotatably supported behind the shafts 15 and 30.

A drive pulley 43 with a sleeve portion 43A is rotatably coupled onto the right portion of the main shaft 42. The drive pulley 43 is connected to a motor 42A and is constantly rotatingly driven by the motor 42A when the power source switch 42B is on no matter whether the drive pulley 43 is in the waiting state or in the operating state brought about by the depression of the key 42C.

Provided on the main shaft 42 is a cycle clutch 44 rightwardly of the drive pulley 43.

Figure 4:
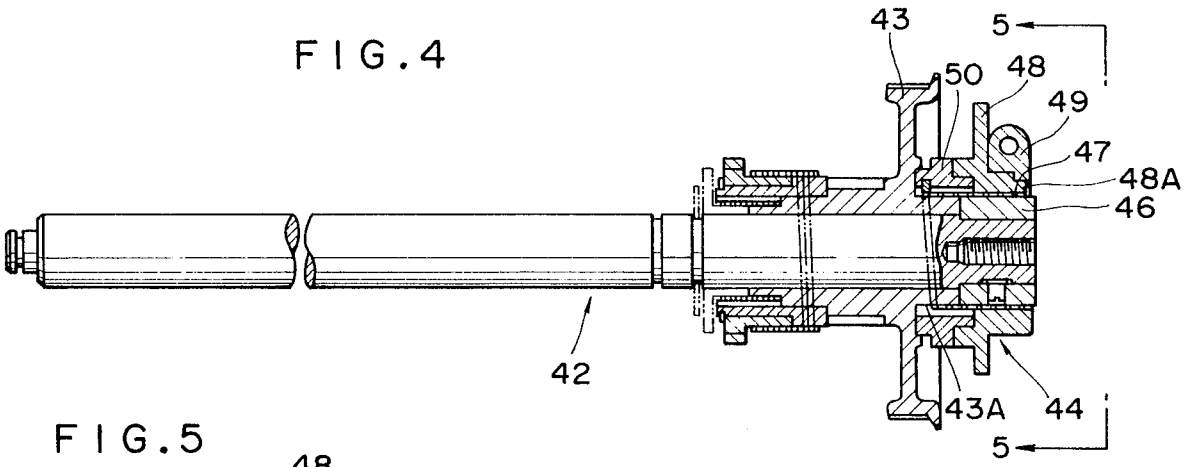
FIG. 4 is a longitudinal sectional view showing the construction of the cycle clutch on the main shaft.
Figure 5:
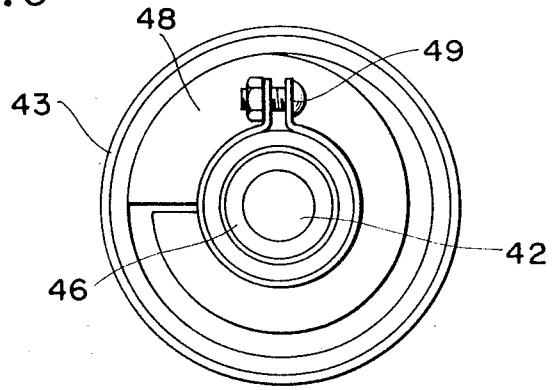
FIG. 5 is a view in the direction indicated by the arrows from the line 5—5 in FIG. 4.

In FIGS. 3 through 5, the cycle clutch 44 comprises: a hub 46 solidly secured to the main shaft 42; a spring 47 wound around the outer periphery of the hub 46 and the outer periphery of a sleeve portion 43A of the aforesaid drive pulley 43; a cycle cam 48 positioned on the outer periphery of the hub 46 and clamping the spring 47 between the outer periphery of the hub 46 and itself; a clamp 49 for solidly securing the cycle cam 48 and one end of the spring 47 through clamping the outer periphery of a boss portion 48A of the cycle cam 48; and a sleeve 50 engaged with the other end of the spring 47 and rotatably coupled onto the main shaft 42 in concentric relation therewith.

The aforesaid spring 47 is wound around the outer periphery of the sleeve portion 43A of the drive pulley 43 with a friction resistance of a predetermined value being generated therebetween.

The outer periphery of the aforesaid cycle cam 48 has a cam-shaped portion as shown in FIG. 5, and rotates in the clockwise direction (as viewed from the right side) integrally with the drive pulley 43 and the main shaft 42 during clutch-on condition.

Figure 6:
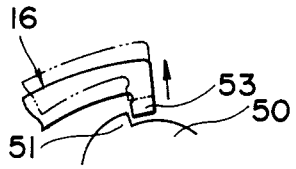
FIG. 6 is a view in explanation of the engagement of the clutch bell crank with the cycle clutch.

As shown in FIG. 6, an engageable projection 51 is provided on the outer periphery of the sleeve 50.

The aforesaid clutch bell crank 16 (Refer to FIG. 3) is provided at the right portion thereof with a bifurcated portion 52, one portion of the bifurcated portion being formed at the forward end portion thereof with an engageable portion 53 that is engaged with the engageable projection 51 of the sleeve 50 in the waiting state (during clutch-off) to prevent the sleeve 50 from rotating, and the other portion of the bifurcated portion 52 being formed at the forward end portion thereof with an abutting portion 54 capable of abutting against the cam-shaped portion on the outer periphery of the aforesaid cycle cam 48.

In the aforesaid cycle clutch 44, when the engageable portion 53 is engaged with the engageable projection 51 (as indicated by a solid line in FIG. 6), the sleeve 50 is prevented from rotating and the spring 47 is precluded from being wound onto the drive pulley 43, whereby no rotational driving force is imparted from the drive pulley 43 to the main shaft 42, so that the main shaft 42 remains stopped.

When the clutch bell crank 16 is rotated in the counterclockwise direction to release the engageable portion 53 from the sleeve 50 (as indicated by a two-dot chain line in FIG. 6), the sleeve 50 becomes free, the spring 47 is wound onto the drive pulley 43 by friction as tight as possible, whereby the drive pulley 43 is connected to the main shaft 42 through the spring 47, so that the main shaft 42 is rotatingly driven (the clutch 44 is turned on).

However, since the abutting portion 54 of the clutch bell crank 16 is pressed upwardly by a raised portion of the cycle cam 48 during a full turn of the main shaft 42, the clutch bell crank 16 is turned again in the clockwise direction and the engageable portion 53 of the clutch bell crank 16 engages the sleeve 50 to stop the windup of the spring 47, whereby no torque is imparted from the drive pulley 43 to the main shaft 42, so that the clutch 44 is turned off. In other words, the main shaft 42 is adapted to make a full turn while the clutch bell crank 16 rotates in the clockwise direction.

The aforesaid main shaft 42 has coupled thereto a combination of cams 65, 66 and 67 for rendering to a forward end engageable portion 64 of the actuating bail 29 a motion drawing an elliptical moving path indicated by an arrow A in FIG. 8. This combination of cams consist of three cams including a cam 65 shown in FIG. 8 and two cams 66 and 67 shown in FIG. 7.

The first cam 65 abuts against one end of a crank 68 rotatably supported on the shaft 30 to render to the crank 68 a rocking motion of a predetermined mode. Provided at the other end of the crank 68 is a stud 70 loosely coupled into a hole 69 of the aforesaid bail guide 35. Consequently, as the crank 68 performs the rocking motion, the bail guide 35 vertically moves in a predetermined mode.

On the other hand, the second and third cams 66 and 67 are adapted to render to the shaft 30 a rocking motion of a predetermined mode.

Figure 7:
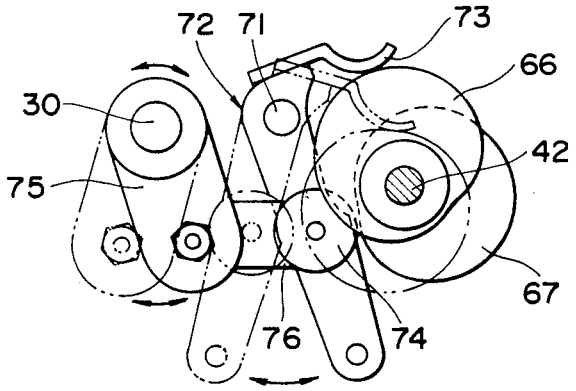
FIG. 7 is a right side view showing the rocking motion mechanism by the cam on the main shaft.

In FIG. 7, pivotally supported on a pivot 71 is an actuating cam follower 72, which is formed with a follower portion 73 for abutting against the second cam 66 and a follower roller 74 for abutting against the third cam 67. Consequently, the actuating cam follower 72 performs the rocking motion between a solid line and a two-dot chain line in FIG. 7 during a full turn of the main shaft 42.

On the other hand, solidly secured to the shaft 30 is a lever 75, which is connected to the actuating cam follower 72 through a link 76.

Consequently, the lever 75 also rocks between a solid line and a two-dot chain line in FIG. 7, and the shaft 30 performs a reciprocatorily rocking motion of a predetermined mode during a full turn of the main shaft 42 (in the rotational direction).

The shaft 30 is solidly secured thereto with the arm 31 as shown in FIG. 8 (as viewed from the right side), whereby the arm 31 performs a rocking motion in accordance with the rocking motion of the shaft 30 as described above. As a result, the actuating bail 29 performs the rocking motion back and forth through a rod 32 loosely coupled into the hole 33 of the arm 31.

The pin 34 of the actuating bail 29 is loosely coupled into a lateral slot 36 of the bail guide 35 as described above and the bail guide 35 is vertically moved by the crank 68, whereby the forward end engageable portion 64 of the actuating bail 29 performs the motion along the elliptical moving path indicated by the arrow A during a full turn of the main shaft 42 from a home position to return to the home position in FIG. 8.

The forward end engageable portion 64 of the actuating bail 29, during the elliptical motion, abuts against the abutting portion 76 of the interposer 7, which has been pressed down and moved rearwardly to thereby move the interposer 7 in a direction indicated by an arrow B (in the forward direction). However, the forward end engageable portion 64, during the motion along the moving path indicated by the arrow A, moves downwardly to reach a point C, where the forward end engageable portion 64 is disengaged from the interposer 7 and interposer 7 is restored to the original position through the agency of the return spring 9 thereof. The forward end engageable portion 64 of the actuating bail 29, after releasing the interposer 7, further moves along the rearwardly directed course at the underside, and returns to the home position shown in FIG. 8.

Figure 2:
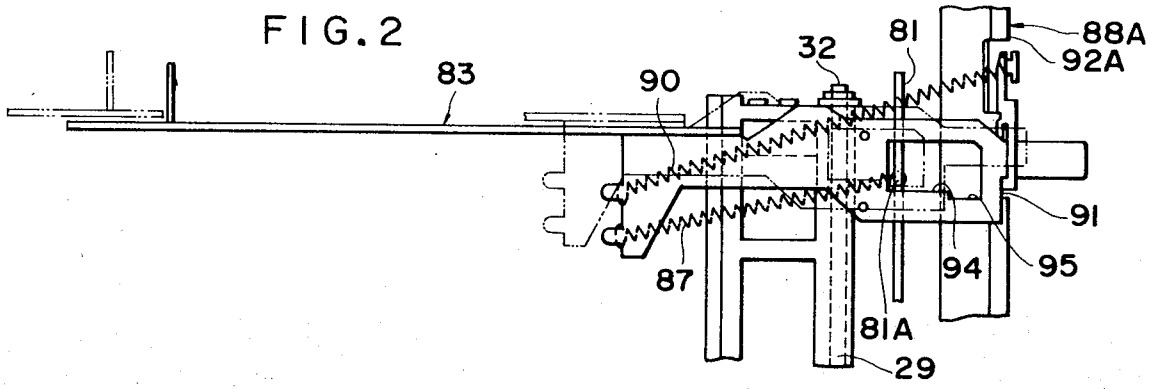
FIG. 2 is a bottom view showing the backspace link and backspace rack.

In FIGS. 1 and 2, a backspace link 83, engaged at the forward end thereof with a shaft 80 and guided at the rear end thereof by a support 81, is disposed below the aforesaid interposer 7.

An interposer follower 85 rotatable about a shaft 84 fixed to the frame 1B is provided between the interposer 7 and the backspace link 83. When the interposer 7 moves forwardly the interposer follower 85 is rotated by a projection 86 in the counterclockwise direction in FIG. 1 to move the backspace link 83 engaged therewith forwardly.

The backspace link 83 is urged by a spring 87 stretched between the support 81 rearwardly (FIGS. 1 and 2) and leftwardly (FIG. 2), and held at a position indicated by solid lines in the waiting state.

A backspace rack 88A extending laterally of the typewriter is disposed adjacent the rear end portion of the backspace link 83. The backspace rack 88A is supported rotatably about a pivot 89 and held in the waiting position indicated by solid lines in the state where it is caused to abut against a shoulder 91 of the backspace link 83 by a spring 90 stretched between the backspace link 83 and itself. Behind the carriage 100, an escapement rack 88B is provided parallel to the rack 88A. As shown in detail in FIG. 11, rack teeth 92B are formed in the upper rear edge of the rack 88B.

Additionally, as shown in FIGS. 1 and 8, the actuating bail 29 is provided at the lower side portion thereof with a projection 93 for abutting against and pressing down the backspace link 83 when the actuating bail 29 moves to the lower position.

As shown in FIG. 2, an opening 94 is formed in the backspace link 83. This opening 94 has a recess 95 for engaging a cutout end edge 81A of the support 81 to lock the backspace link 83 when the backspace link 83 moves forwardly.

Figure 9:
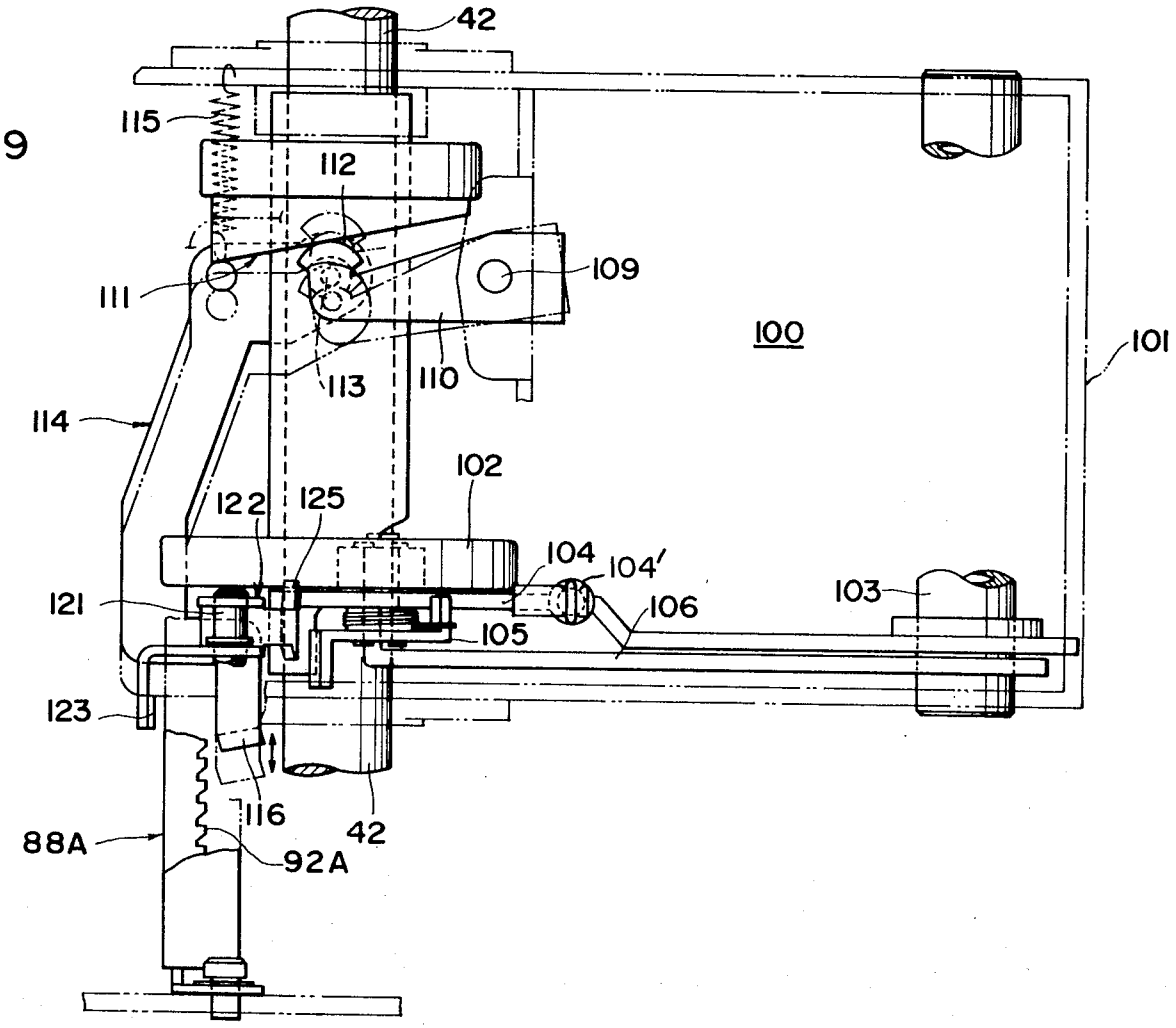
FIG. 9 is a plan view showing the operation of the backspace pawl and the like on the carriage.
Figure 10:
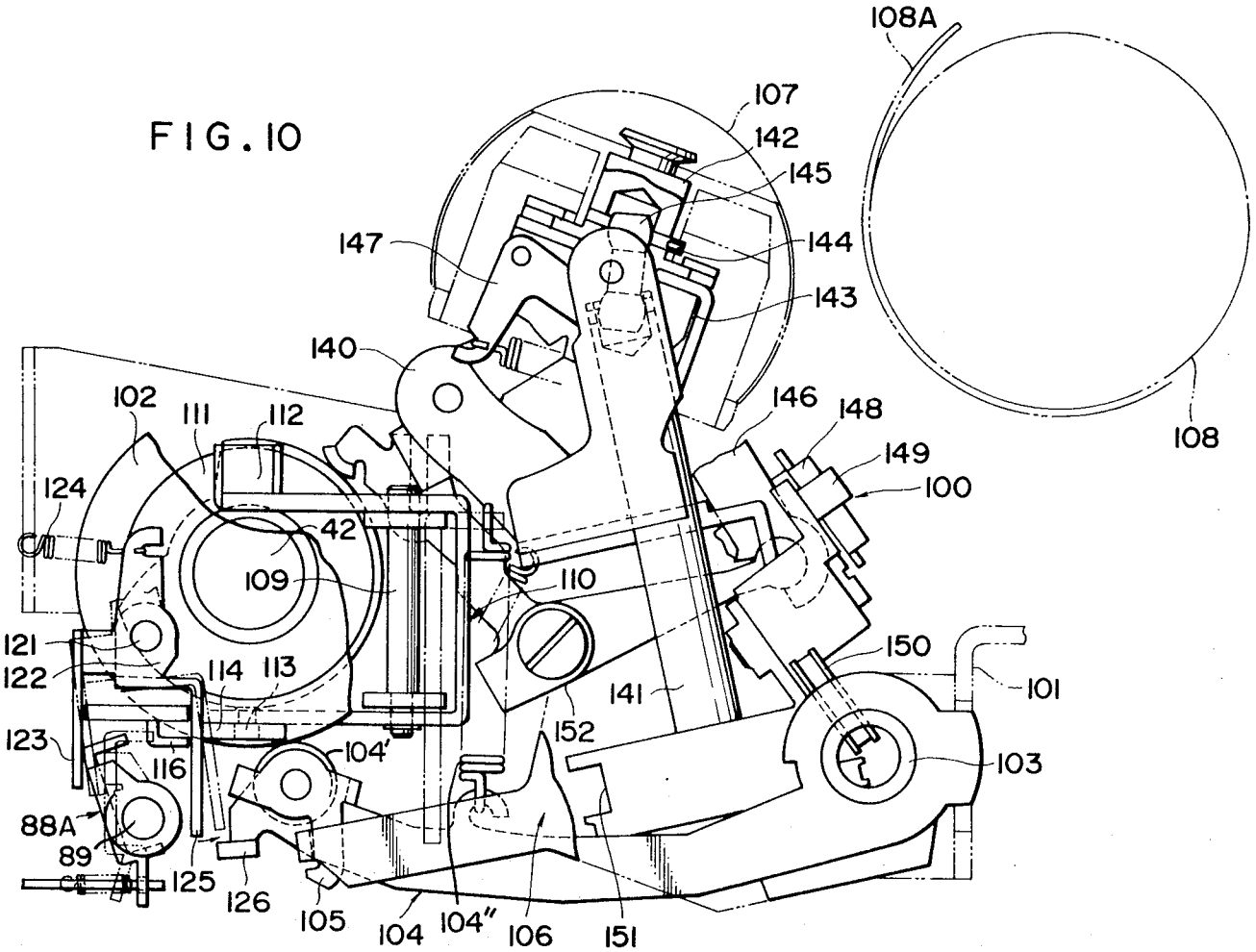
FIG. 10 is a right side view of FIG. 9.
Figure 11:
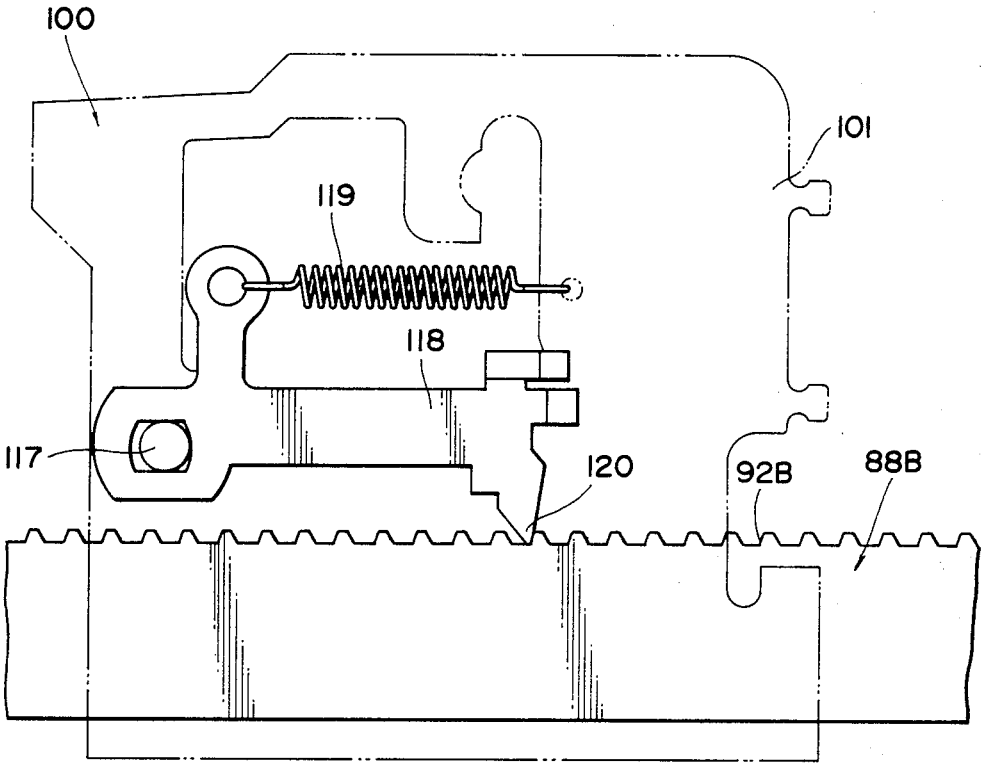
FIG. 11 is a plan view showing the escapement pawl on the carriage.
Figure 14:
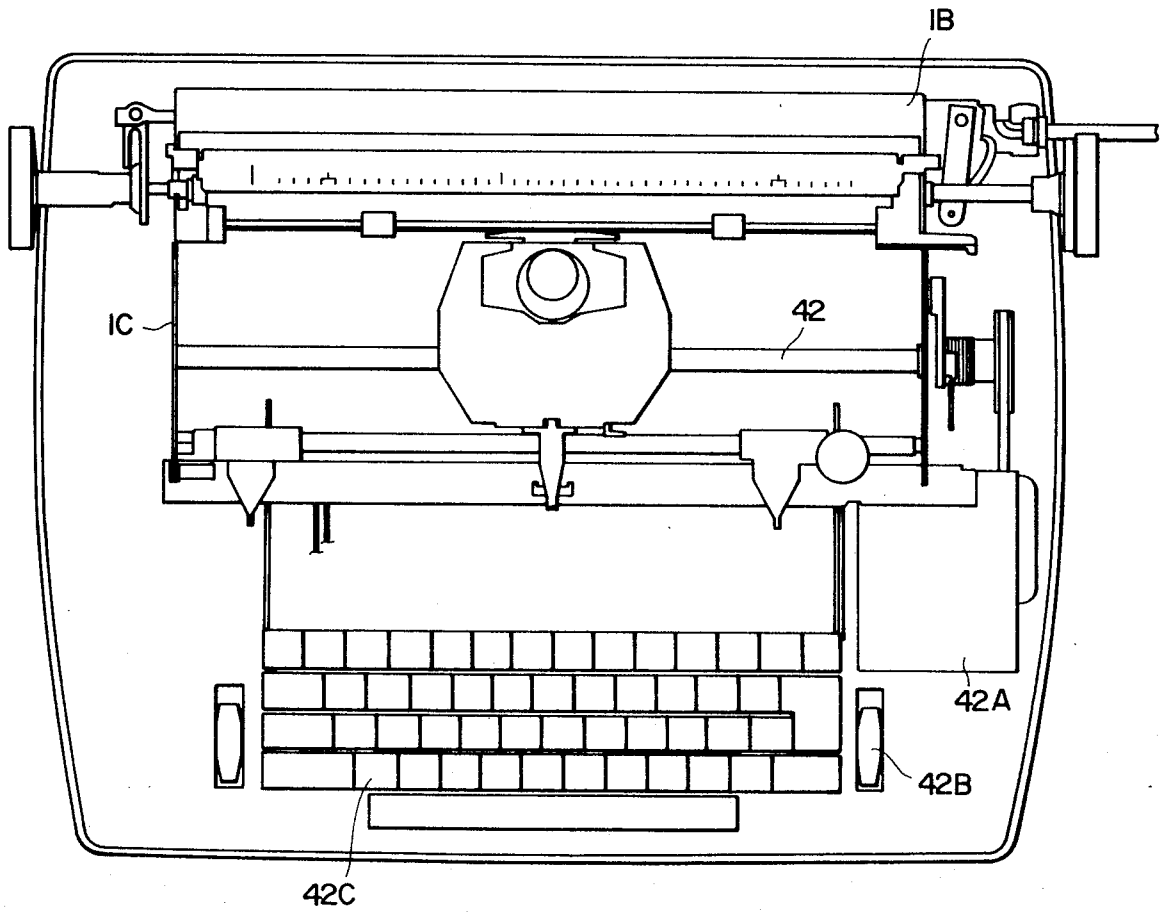
FIG. 14 is a top plan view of a typewriter in accordance with the teaching of the present invention.

In FIGS. 9 through 11, a carriage 100 provided thereon with a printing mechanism is slidably supported by the main shaft 42.

The carriage 100 includes: a carriage frame 101; a printing cam 102 pivotally supported by the carriage frame 101 and rotatable with the main shaft 42; a printing arm 104 supported rotatably about a shaft 103 and rockably following the cam shape of the printing cam 102 through a cam follower roller 104'; a rocker bracket 106 supported rotatably about the shaft 103 in the same manner as the printing arm 104 is and engaged with the printing arm 104 through a trigger 105; and a typehead 107 rotatably and vertically movably supported on the rocker bracket 106, etc.

During printing operation, the printing cam 102 rotates integrally with the main shaft 42 and, when the printing arm 104 is rocked upwardly by the printing cam 102 through a spring 104'', the rocker bracket 106 is rocked upwardly through the trigger 105. Thereupon, a letter selecting mechanism is operated to select positions of the typehead 107 in the rotational direction and in the vertical direction, i.e. a letter. The letter selecting mechanism as seen in FIG. 10 includes a yoke 140, shaft 141 for rotating the ball socket 142, a tilt link 143, pin 144, ball joint 145, link 146, detent lever 147, bell crank 148, pin 149, tilt pulley 150, rotation pulley 151 for rotating shaft 141 and cam follower 152 for operating link 146. Thus, the typehead 107 is pressed against a sheet of paper 108A on the platen 108, thereby enabling to print a given letter.

A backspace cam follower 110 rocking about a vertical shaft 109 horizontally and laterally is provided on the carriage frame 101. This backspace cam follower 110 is of substantially a U-shape as viewed from sideways, provided at the forward end of the upper leg thereof with an abutting portion 112 for abutting against an end face cam 111, and connected at the forward end of the lower leg thereof by pin 113 to a backspace pawl 114.

The end face cam 111 is pivotally supported on the carriage frame 101 in a manner to be rotatable integrally with the aforesaid printing cam 102. Consequently, the end face cam 111 is laterally slidable on the main shaft 42, and moreover, rotatable integrally with the main shaft 42.

The backspace pawl 114 is urged leftwardly from the typewriter (upwardly in FIG. 9) by a spring 115 stretched from the carriage frame 101 and itself. The aforesaid backspace cam follower 110 is urged against the cam face of the end face cam 111 by this spring 115 and accurately follows the end face cam 111 to be rocked.

A toothed portion 116 is formed at the forward end portion of the backspace pawl 114. This toothed portion 116 is opposed to rack teeth 92A of the backspace rack 88A through a space when the backspace rack 88A is in the waiting state, i.e. at a position indicated by solid lines in FIG. 1. However, when the backspace rack 88A is rotated to reach a position indicated by two-dot chain lines in FIG. 1, the toothed portion 116 is adapted to be meshed with one of the rack teeth 92A.

As clearly shown in FIG. 11, the rack teeth 92B of the escapement rack 88B are formed such that the rack teeth 92B are arranged at a predetermined pitch and have such tooth forms that the left side surface of each tooth 92B is steeply inclined at an angle close to 90° and the right side surface is comparatively moderately inclined.

As shown in FIG. 11, separately of the aforesaid backspace pawl 114, the carriage frame 101 is provided thereon with an escapement pawl 118 rotatable about a vertical shaft 117. This escapement pawl 118 is urged in the clockwise direction in FIG. 11 by a spring 119 stretched between the carriage frame 101 and itself, and normally a toothed portion 120 at the forward end thereof is held to be meshed with the rack teeth 92B of the escapement rack 88B.

In FIGS. 9 and 10, a printing arm latch 122 rotatable about a pivot 121 on the carriage frame 101 is provided. The latch 122 is substantially a bifurcated shape as viewed from sideways, and a front leg 123 thereof, during the waiting time, abuts against the backspace rack 88A to hold the latch 122 in a released position against a spring 124. When the backspace rack 88A is rotated to the working position indicated by two-dot chain lines, the latch 122 is rotated in the counterclockwise direction by the spring 124, whereby a rear leg 125 comes to a position of being engageable with a stoper portion 126 of the printing arm 104, so that the printing arm 104 can be prevented from moving upwardly, thereby enabling to preclude the printing operation.

In FIG. 1, the backspace key lever 3 is provided thereon with a first repeat lever 130 and a second repeat lever 131, which are journalled through pins 127 and 128, respectively, and freely movably connected to each other through ball joint 129. Provided at the lower end of the first repeat lever 130 is an abutting portion 133 adapted to contact the interposer 7 when a key top 132 is deeply pressed down, a compression spring 134 is confined between the first repeat lever 130 and the key lever 3, and the first repeat lever 130 is provided thereon with an engageable portion 135.

Description will hereunder be given of the backspace device in the typewriter as described above.

If the key top 132 is depressed to press the backspace lever 3 downwardly, then the interposer 7 is pressed down and released from the stop spring 10. Then, the interposer 7 is moved rearwardly by the resiliency of the spring 9 and abuts against the cycle bail 13 to rotate the same in the counterclockwise direction.

When the cycle bail 13 is rotated, the clutch bell crank 16 is rotated in the counterclockwise direction from a state in FIG. 12 to a state in FIG. 13 by the resiliency of the spring 17. Thereupon, the engageable portion 53 of the clutch bell crank 16 is released from the sleeve 50, whereby the cycle clutch 44 is turned on, thereby rotating the main shaft 42. When the main shaft 42 makes a full turn, the clutch bell crank 16 is turned in the clockwise direction through the agency of the cycle cam 48 to return to the original position, whereby the cycle clutch 44 is turned off. In other words, each time the key top 132 is depressed, the main shaft 42 makes a full turn and stops.

When the main shaft 42 turns, the combination of the cams 65, 66 and 67 fixed thereon turn, whereby the shaft 30 rockingly rotates and the crank 68 journalled on the shaft 30 rocks. As a result, simultaneously with the rocking of the arm 31 fixed on the shaft 30 in a predetermined mode, the bail guide 35 connected to the other end of the arm 68 vertically moves in a predetermined mode. Consequently, the arm 31 and the actuating bail 29 connected to the bail guide 35 perform a cycle motion in a predetermined mode, and the forward end engageable portion 64 performs the motion along the elliptical moving path indicated by the arrow. A starting from the home position shown in FIG. 8 and returning to the home position again.

While the interposer 7 is moved forwardly by the actuating bail 29, the backspace link 83 is moved forwardly through the interposer follower 85. The recess 95 of the backspace link 83 is engaged with the support 81, whereby the backspace link 83 is locked at a forward position indicated by two-dot chain lines in FIG. 2. Corresponding thereto, the backspace rack 88A is rotated to the working position indicated by the two-dot chain lines in FIGS. 1 and 10, and engaged with the toothed portion 116 of the backspace pawl 114 on the carriage frame 101.

In addition, rotation of the main shaft 42 rotates the end face cam 111 of the carriage 100, whereby the backspace cam follower 110 on the carriage 100 rocks between the positions indicated by the solid lines and the two-dot chain lines in FIG. 9. Consequently, the backspace pawl 114 connected to the backspace cam follower 110 rocks in the lateral direction against the tensile force of the spring 115 from a position indicated by solid lines to a position indicated by two-dot chain lines in FIG. 9. This backspace pawl 114 moves in the lateral direction by a predetermined value for covering one pitch of the rack teeth 92A of the backspace rack 88A during a full turn of the main shaft 42. As a result, when rocking to the right, the backspace pawl 114 urges the backspace rack 88A, which is fixed, and the resultant reaction force causes the carriage 100 to move to the left by one pitch. In this case, the escapement pawl 118 shown in FIG. 11 slides over the moderately inclined portion of one of the rack teeth 92B to move to left, and, when the carriage 100 has moved by one pitch, the escapement pawl 118 is engaged with the left side surface (the steeply inclined surface close to the right angle) of the succeeding one of the rack teeth 92B, whereby the carriage 100 is stopped at a position to which the carriage 100 is returned by one pitch. In addition, the carriage 100 is constantly urged by a predetermined value of a resiliency through a spring 119 in a direction along the backspace pawl 114 extending, whereby the carriage 100 tends to move to the left in FIG. 11. However, the aforesaid escapement pawl 118 is meshed with one of the rack teeth 92B as shown in FIG. 11, thus enabling to accurately stop the carriage 100. At this time, the backspace pawl 114 returns to the original position, sliding over the moderately inclined surface of one of the rack teeth 92A.

Thereafter, while the actuating bail 29 descends and moves rearwardly, the interposer 7 is returned to the original position by the resiliency of the spring 9, the backspace link 83 is depressed by the projection 93 to be released from the locking with the support 81 and returned to the original position by the resiliency of the spring 87. As a result, the backspace rack 88A is also returned to the original position.

On the other hand, in the case of the backspace operation, the rotation of the backspace rack 88A rotates the printing arm latch 122 to reach the position of engaging the printing arm 104. As a result, even if the printing cam 102 rotates integrally with the main shaft 42, the printing arm 104 is prevented from moving in the vertical direction. Consequently, the rocker bracket 106 engaged through the trigger 105 with the printing arm 104 is also prevented from turning, thereby precluding the printing operation.

In addition, if the key top 132 is depressed by a force higher than the ordinary urging force, the abutting portion 133 of the first repeat lever 130 abuts against the interposer 7, which does not return to the original position where it can be engaged with the stop spring 10, continually rotates the cycle bail 13, turns the cycle clutch 44 on, and turns the main shaft 42 a few times. As a result, the retraction (movement to the left) of the carriage 100 can be successively performed pitch by pitch.

As has been described hereinabove, according to the present invention, a backspace device in a typewriter simplified in construction, rendered compact in size, and moreover, operable accurately and smoothly can be provided at a low cost.

What is claimed is:

1. A backspace device in a typewriter comprising:

an interposer operable by the operation of a key lever:

a cycle bail operable by said interposer;

a cycle clutch for intermittently transmitting a driving force from a driving source to a main shaft so that the main shaft can be rotated by a predetermined number of times in association with said cycle bail;

an actuating bail for performing a cycle of a motion along a moving path of a predetermined mode by a full turn of said main shaft, while rendering to said interposer a motion in a direction of said interposer leaving the cycle bail during said motion;

a backspace link for moving in association with said interposer during the leaving motion of said interposer;

a backspace rack extending laterally of the typewriter, supported rotatably about an axis laterally disposed and turned to a working position by said backspace link; and a backspace pawl fastened onto a carriage so that said backspace pawl can be reciprocated a predetermined distance in the lateral direction by a cam rotatable integrally with the main shaft and having a toothed portion to be meshed with said backspace rack rotated to said working position; characterized in that the carriage is retracted by a predetermined value of pitch along the main shaft by a reaction force generated at a portion of the engagement of the backspace pawl with the backspace rack by a motion of the backspace pawl.

2. A backspace device as set forth in claim 1, characterized in that a printing arm latch is provided which is pivotally supported by said carriage, and which is engaged with a printing arm on the carriage, when the backspace rack turns, to prevent the printing arm from moving upwardly, thereby stopping the printing operation.

3. A backspace device as set forth in claim 1 or 2, characterized in that said carriage is provided thereon with an escapement pawl engageable with an escapement rack, whereby said carriage is retractable, but prevented from moving in a direction opposite thereto.

* * * * *